US005137601A

United States Patent [19]

Hsu

[11] Patent Number: 5,137,601

[45] Date of Patent: Aug. 11, 1992

[54] PAPER FORMING FABRIC FOR USE WITH A PAPERMAKING MACHINE MADE OF PPT FIBERS

[75] Inventor: Chien-Yeh Hsu, Greer, S.C.

[73] Assignee: Wangner Systems Corporation, Greenville, S.C.

[21] Appl. No.: 721,291

[22] Filed: Jun. 26, 1991

[51] Int. Cl.[5] ..... D21F 7/08; D03D 15/00

[52] U.S. Cl. ..... 162/358.2; 162/900; 162/902; 428/229; 428/234; 428/287

[58] Field of Search ..... 162/358, 348, DIG. 1; 428/229, 234, 287

[56] References Cited

U.S. PATENT DOCUMENTS

| | | | |
|---|---|---|---|
| 4,259,394 | 3/1981 | Khan | 162/348 |
| 4,289,173 | 9/1981 | Miller | 162/DIG. 1 |
| 4,350,731 | 9/1982 | Siracusano | 162/DIG. 1 |
| 4,719,139 | 1/1988 | Gauthier | 162/DIG. 1 |
| 4,815,499 | 3/1989 | Johnson | 162/DIG. 1 |
| 4,861,660 | 8/1989 | Ishii | 428/371 |
| 4,935,276 | 6/1990 | Pawlowski et al. | 428/233 |
| 4,973,510 | 11/1990 | Tanaka | 428/226 |
| 4,973,512 | 11/1990 | Stanley et al. | 428/229 |

*Primary Examiner*—Karen M. Hastings
*Attorney, Agent, or Firm*—Cort Flint

[57] ABSTRACT

A papermaking fabric for use in a papermaking machine having a base fabric formed of synthetic filament machine direction and cross-machine direction yarns. A fiber batt formed of synthetic fibers secured to at least a support surface of the base fabric. Both the fibers and the filaments are formed of polypropylene terephthalate so that a papermaking press fabric having chemical resistance characteristics of polyester fabrics and physical properties of nylon fabrics is produced.

17 Claims, 3 Drawing Sheets

PAPER FORMING FABRIC FOR USE WITH A PAPERMAKING MACHINE MADE OF PPT FIBERS

This invention relates to a papermaking press fabric of improved chemical resistance having polypropylene terephthalate (PPT) as the base material.

BACKGROUND OF THE INVENTION

Papermaking machines are divided into three dewatering sections; the forming section, the press section, and the drying section. Each section employs a papermaking fabric.

The forming section receives a paper forming slurry of pulp which is approximately only 0.5% solid material. The slurry is delivered on to a forming fabric which acts to drain the water from the slurry to a point that the solid content is increased to between 18% and 23%, and slurry of pulp is formed into a sheet.

The press section receives the sheet of pulp onto a press fabric, which in cooperation with press rolls, further drains the water to increase the solid content of the sheet of pulp to between 36% and 44%.

The dryer section receives the sheet of pulp from the press section onto a dryer fabric which carries it through the section. The dryer fabric also serves as a backing medium to press the pulp sheet against heated cylinders which achieve the desired dryness.

The use of chlorine and other oxidation agents in the papermaking process has proven to be problematic because these chemicals deteriorate the forming materials of the papermaking fabrics. Attempts have been made to improve the chemical resistance of papermaking fabrics with the selection of various synthetic materials and various fabric forming techniques and structures. The one constant that always remained was that the materials forming the press fabric having the desired strength, durability, and elasticity quality did not have the chlorine resistance qualities.

U.S. Pat. No. 4,973,512 is an example of such an attempt. The patent discloses using polybutylene terephthalate filaments (PBT) to form the base fabric. This product contains some physical properties similar to nylon and, at the same time, has a high degree of resistance to chlorine. The fiber batt used with the base fabric is composed of polyethylene terephthalate (PET) which does not possess the physical properties of nylon. The resultant felt therefore exhibits an adequate chemical resistance to chlorine, but has inferior physical properties in comparison to nylon felts.

It is an object of this invention to produce a papermaking press fabric which overcomes the disadvantages of the prior art as indicated above.

It is another object of the invention to provide a papermaking press felt having the elasticity characteristics and wearability of nylon so that the fabric will have superior runnability on the paper machine.

Another object of the invention is to produce a papermaking press fabric having equal physical and chemical resistant properties in both its base fabric and its fiber batt which is secured to the base fabric.

It is an object of the invention to produce a chlorine resistant papermaking fabric in which the base fabric has sufficient elasticity to allow the needling of fiber batts thereto with a minimum fiber and yarn damages.

SUMMARY OF THE INVENTION

A papermaking press fabric for use on the paper machine having machine direction and cross-machine direction monofilament yarns inter-associated to present an upper support surface and an inner lower surface. The machine direction yarns, the cross-machine direction yarns, and the batt fibers are formed of polypropylene terephthalate. The papermaking press fabric may be woven in any of a number of weave patters to include a plain weave, a duplex weave, a twill or modified twill weave, and a satin weave. The papermaking fabric may also be formed as a spiral coiled fabric.

The machine direction yarns may have a circular cross-section with a diameter of between 0.004 and 0.03 inches, or they may be substantially rectangular in cross-section and have a height of between 0.010 to 0.030 inches and a width of between 0.02 and 0.04 inches.

The fiber batt is formed of PPT fibers of between 3 and 60 deniers, and is needled to the support and the lower surface of the fabric. The batt can be single layer or multi-layer depending on the design of the felt.

A papermaking press fabric for use on a papermaking machine including a base fabric formed of machine direction and cross-machine direction PPT monofilament warp and weft yarns interwoven to form single, double, or triple layer fabrics. The machine direction yarns may be circular, or rectangular in cross-section and the cross-machine yarns may be circular or rectangular in cross-section. A variation of woven fabric is a spiral coil fabric. The machine direction yarns in a coil fabric is composed of coiled PPT monofilaments. A series of such coils are connected together with monofilament pintles made of PPT to form fabrics in the desired width and length.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
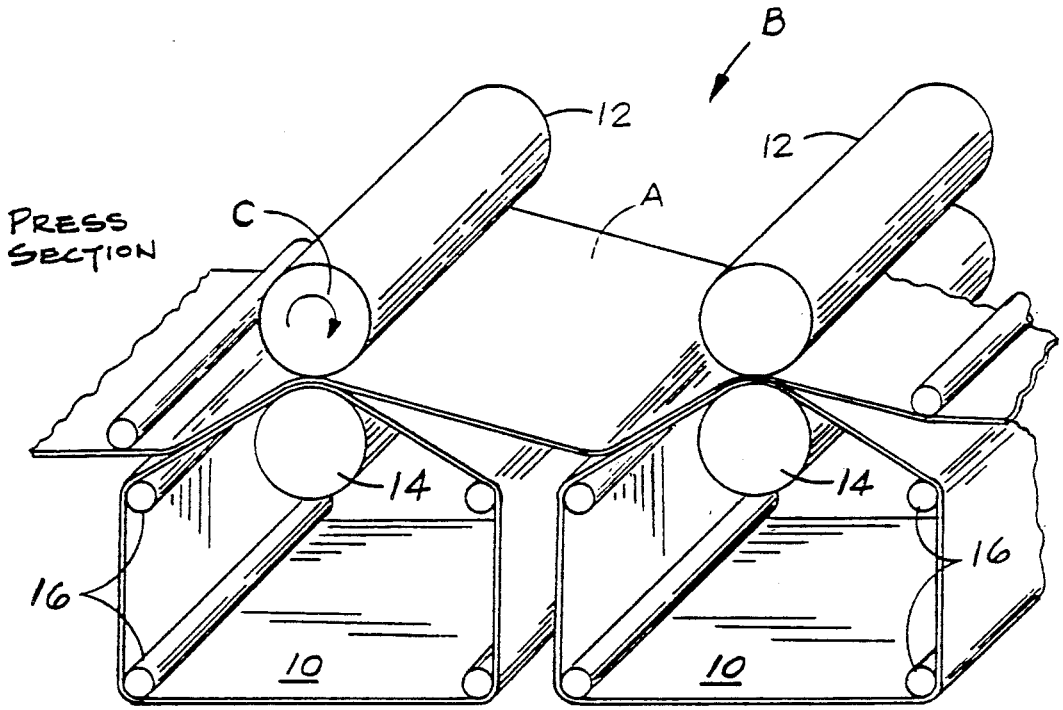
FIG. 1 is a diagrammatic view of the press section of a paper machine.

Referring now to the drawings, FIG. 1 illustrates a schematic representation of a press section of a paper forming machine. Normally, the papermaking process includes a forming section, a press section and a dryer section. Since the instant invention is primarily directed to a press fabric, only that section has been shown. It should be emphasized that the invention is in no way limited to the press section but finds equal applicability in either the forming section or the dryer section with only minor adjustments in the fabric density an structure which are obvious to those skilled in the art.

The paper sheet A is formed in the forming section and is delivered to the press section B by suitable means. Here, it is brought into contact with press felt or fabric 10. The press felt 10 is driven in the direction of arrow C so as to carry paper sheet A into engagement with at least one nip roll 12 which operates in concert with nip roll 14. Here, most excess water is forced out of sheet A preparing it for drying in the dryer section.

While only two pair of nip rolls 12 and 14 are shown various selected numbers and configuration of press of sections may be arranged in tandem as the moisture removal and finish requirements vary between products.

As illustrated in FIG. 1, as paper sheet A moves into the press area, nip roll 12 comes into direct contact with the paper sheet. Press fabric 10 carrying paper sheet A separates nip roll 12 from direct contact with the paper sheet A. The nips of nip rolls 12 and 14 extract a desired amount of fluid from the paper sheet A which is then moved on by fabric 10 and suitable guide rolls 16 to the dryer section. Once the paper web A is removed from fabric 10, the fabric, which is endless, continues around guides 14 to continuously present a portion thereof to the continually supplied paper web A so that the drying process continues uninterrupted.

The nip pressure between nip rolls 12 and 14 may range between 200 to 2000 pounds per linear inch. Such pressures are intended to squeeze the water from paper web A; however, to be effective, the water must also drain through fabric 10, otherwise it will only be reabsorbed in web A. In some instances, the fabric passes over a vacuum section to remove the excessive water before returning to the web receiving position.

It is usual to form fabric 10 of such a construction which provides voids or passageways therethrough to allow the water squeezed from web A to pass through fabric 10 and away from the web. It is also important that the support surface of fabric 10 be as smooth as possible with a minimum of surface irregularities which tend to mark the web.

The production of paper of different characteristics require different arrangements in the papermaking machine and different constructions of the papermaking fabrics. For example, the number of stations in the press section may vary and/or the speed at which the web passes through the section may vary. These variances require papermaking fabrics possessing different structures and capabilities. A constant always is that the papermaking fabric possesses good strength, good stability, and wearability, particularly in the press section. The fabric must possess uniform absorption and drainage characteristics and have good resistance to compression and degradation.

Usually, degradation occurs because the fabric must operate at a high temperature and under great pressures. Another factor, particularly in the production of bleached papers and the like, is chlorine and other chemicals which are employed in the papermaking process.

Water containing chlorine effectively shortens the life of most synthetic materials used to form the fabric. The synthetic materials, so far, which have been selected primarily for their physical properties have not proven satisfactory in resisting chlorine and other agents. Nylon is the most desirable material for forming the press fabric because of its elasticity and wearability. Nylon has a problem resisting chlorine. In the presence of chlorine, nylon fabrics may have its usable life reduced by 50%. PET, on the other hand, has been found to have good resistance to chlorine. However, PET lacks the mechanical properties essential to the formation of acceptable press fabrics.

Filaments and fibers formed of polypropylene terephthalate have proven to be most satisfactory in achieving the desired characteristics of nylon. Polypropylene terephthalate filaments achieve an elasticity which can be as much as twenty percent greater than polybutylene terephthalate (PBT) and at the same time, the fibers and filaments posses abrasion resistance equal to nylon. This synthetic also possesses a resistance to chlorine equal that of polyethylene terephthalate and a thermal resistance greater than nylon.

The much improved elasticity not only results in a further improvement in production as indicated above, but also enables the formation of fibers which may be used to form the batts which are attached to the base fabric.

Press fabric construction in the past consisted of a woven fabric possessing the necessary characteristics or of a woven base fabric to which a batt is attached usually by needling or lamination.

Figure 2:
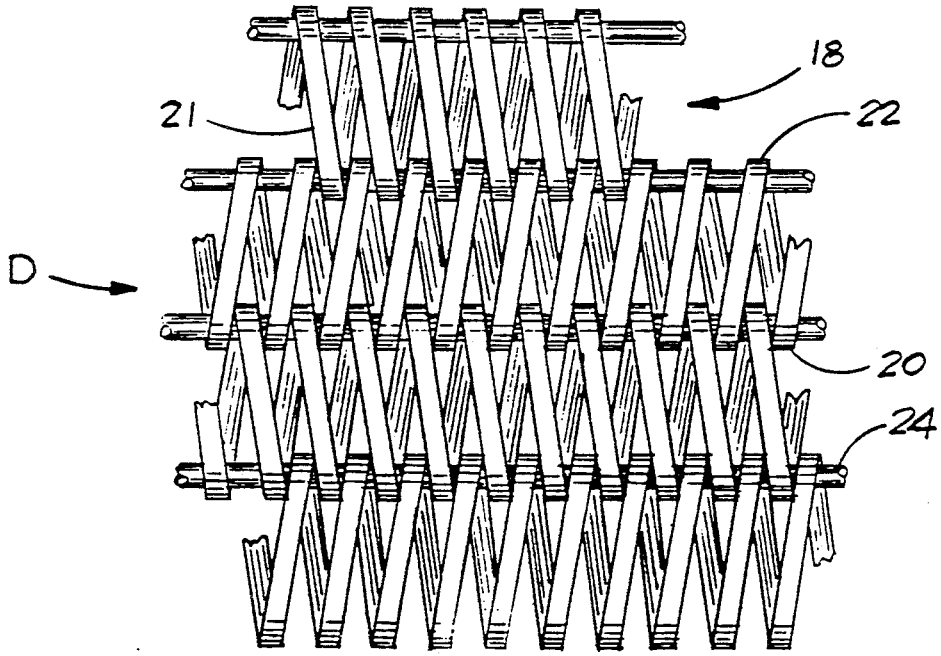
FIG. 2 is a top sectional view of a coil formed fabric according to the invention.
Figure 5:
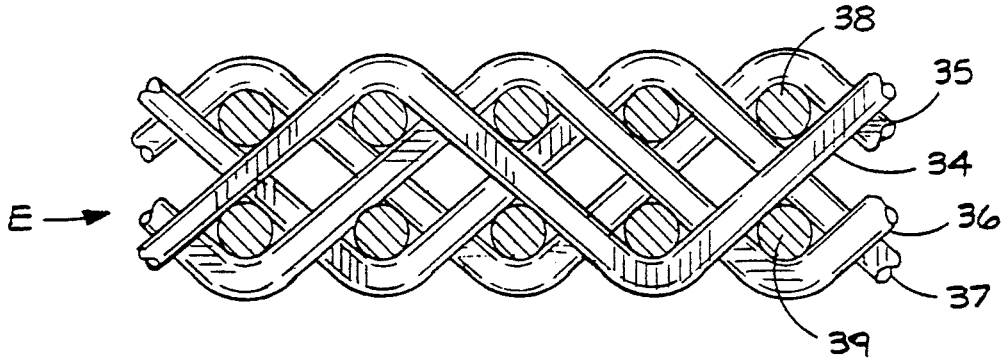
FIG. 5 is a sectional side view of a woven base fabric according to the invention.
Figure 6:
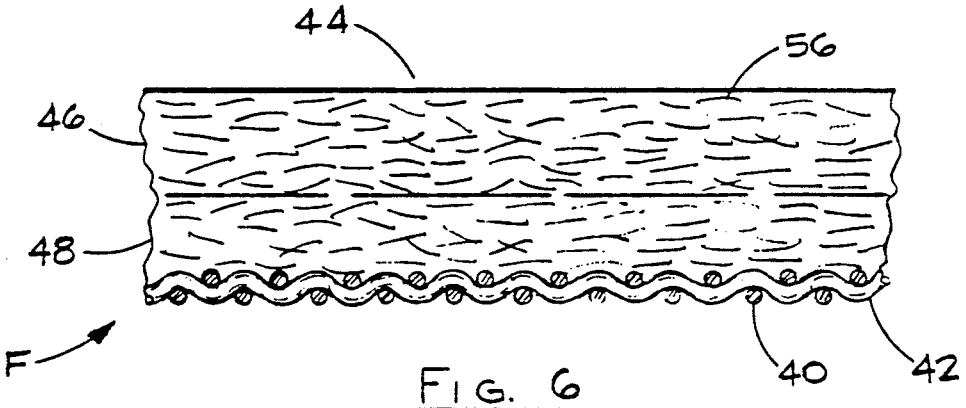
FIG. 6 is a sectional side view showing an alternate weave for the base fabric having a multilayered fiber batt secured thereto.
Figure 7:
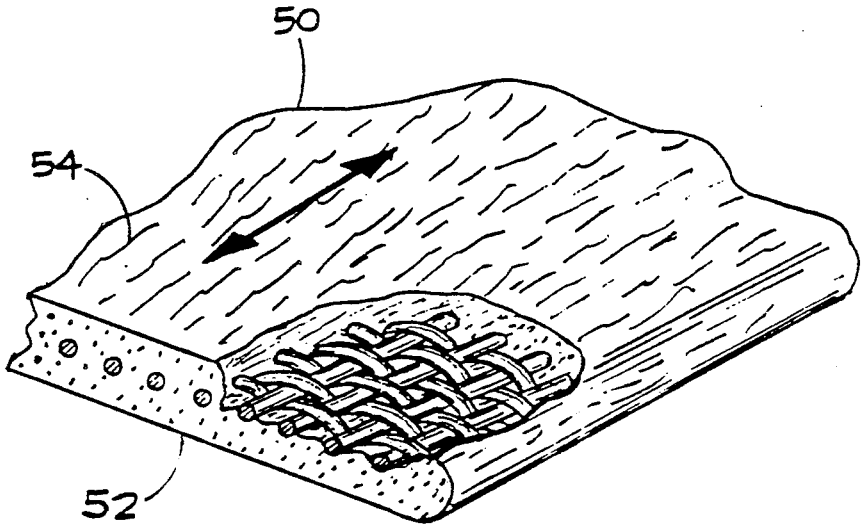
FIG. 7 is a sectional perspective view of a press fabric according to the invention in which a fiber batt is secured to both surfaces of the support fabric.

In the instant invention it is intended that the fabrics for use in the press section of the papermaking machine may be woven, as illustrated in FIGS. 5 and 6, in anyone of several usual weaves or may be formed as a coil fabric as illustrated in FIG. 2. Usually, although not necessarily, the fabric will have a fiber batt attached to its support surface as shown in FIG. 6 or to both surfaces as shown in FIG. 7.

Referring now to FIG. 2, there is shown one form of the invention. Here, press fabric D is formed of a plurality of coils 18 which have forward sections 20 and rear sections 22 engaged with pintles 24 which extend in the cross-machine direction. Coils 18 have flat sections 21 which extend in the machine direction. The coils are arranged in the usual manner, that is every coil is wound in the "S" direction with a clockwise coil and the intervening coils are wound in the "Z" direction with a counter-clockwise coil.

Figure 3:
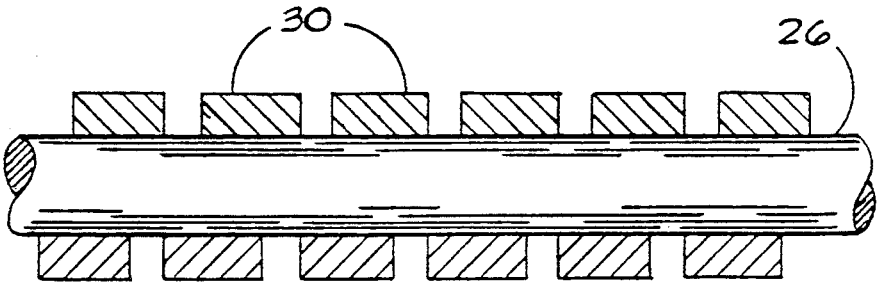
FIG. 3 is a sectional view of a fabric according to the invention showing a cross-sectional configuration of the machine direction yarns.
Figure 4:
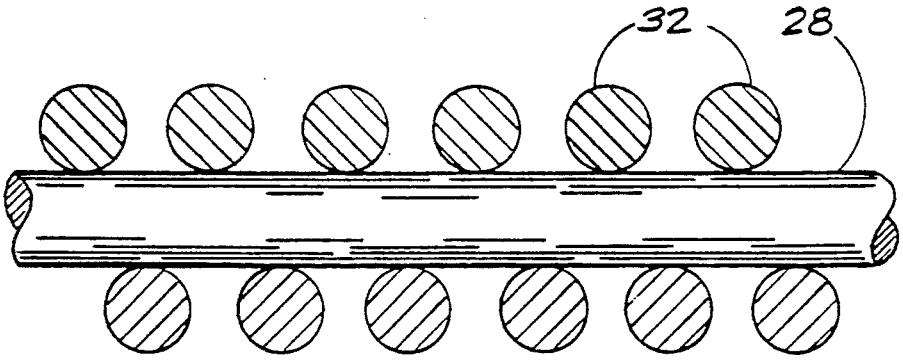
FIG. 4 is a sectional view of a fabric according to the invention showing an alternative cross-sectional configuration for the machine direction yarns.

The coils 18 and pintles 20 are both formed of polypropylene terephthalate monofilaments. The pintles have a circular cross-section as seen at 26 and 28 in FIGS. 3 and 4 while the monofilaments forming coils 18 may be substantially rectangular as seen at 30 or circular in cross-section as seen at 32.

Rectangular cross-section filaments have the advantage of forming a lower profile fabric while at the same time presenting a fuller or more smooth support surface for the paper forming product. Circular monofilaments provide greater drainage capabilities.

Alternate embodiments can be seen in FIGS. 5 and 6. FIG. 5 shows two layer fabric E in which warp filaments 34, 35, 36, and 37 extend in the machine direction and interweave with cross-machine weft yarns 38, 39 in a balanced duplex weave. Both warp filaments 34–37 and weft filaments 38, 39 are formed of polypropylene terephthalate. The warp may have a substantially rectangular cross-section, as seen at 30 in FIG. 3, or a circular cross-section as shown at 32 in FIG,. 4. The weft monofilaments most desirably have the circular cross-section, shown in FIGS. 3 and 4 at 26 and 28, however, in certain circumstances, weft filaments having a rectangular cross-section could be used.

The woven press fabric of the invention is not limited to the structure E shown in FIG. 5, but could also be a single layer woven fabric F, as shown in FIG. 6. Here warp monofilaments 40 weave with weft monofilaments 42 in a plain weave.

Various other weave patterns such as twill, modified twill, sateen, and triplex weaves may also be employed depending upon the intended use and product. Normally, the end count will range between 36 and 64 in the warp direction and between 24 and 34 in the weft direction. The rectangular monofilaments range in height between 0.010 inch and 0.025 inch, in a width between 0.02 inch and 0.035 and have a width/height ration in the vicinity of 2 to 1. The monofilaments of circular cross-section range in diameter between 0.012 into 0.03 inch. In certain instances the circular monofilaments may be united in bundle form forming multifilament yarns of the same general diameters.

To the base fabrics just described, fiber batts as shown at 44 in FIG. 6 and at 50 and 52 in FIG. 7, may be incorporated. In order that all segments of the dryer felt passes uniform qualities of strength, wearability and stability, the fiber batts are also formed of polypropylene terephthalate fibers. The fiber batts vary in construction and density depending on the intended use. Certain products may require a more open batt for improved drainage, others a smooth surface so as to leave no marks on the paper forming product.

The fiber deniers may range from 3 to about 60 with the weight Lasis ranging from about 0.25 oz. per square feet to about 1.5 oz. per square feet. The preferred denier range is between 15 and 20.

Fibers forming the batt are secured to the base fabric, preferably by needling. An inner batt 52 may or may not be provided. Another desirable alternative is to provide a multi-layered support batt as shown at 44 in FIG. 6. Here, the fibers 38 forming fiber batts 46, 48 extend in the cross-machine direction. In another alternative form, the forming fabric may include a multi-layered upper fiber batt with the fibers forming the upper layer extending in the machine direction, the fibers forming the lower layer extending in the cross-machine direction. A fiber batt may alternately also be secured to the lower or inner surface of this forming fabric.

Felts formed to the above specifications have varied from about 4.0 to about 6.0 oz. per square foot with an air permeability of between 60 to 160 cubic feet per minute with a caliber ranging between 0.110 and 0.210 inch.

It will be understood that the press fabrics described above provide maximum resistance to chlorine degradation while at the same time providing a very high degree of flexibility and durability.

It is to be understood that while press fabrics have been described in detail, the instant invention finds equal application in the forming section and the dryer section.

While a preferred embodiment of the invention has pass been described using specific terms, such description is for illustrative purposes only, and it is to be understood that changes and variations may be made without departing from the spirit or scope of the following claims.

What is claimed is:

1. A papermaking fabric for use in a papermaking machine;

said fabric consisting of base fabric consisting of machine direction and cross-machine direction yarns consisting of synthetic filaments;

a fiber batt consisting of synthetic fibers secured to at least a support surface of said base fabric;

said fibers and said filaments consisting of polypropylene terephthalate whereby a papermaking fabric having chemical resistance characteristics of polyester fabrics and physical properties of nylon fabrics is produced.

2. The fabric of claim 1 wherein said fabric is one of a forming fabric, a press fabric, and a dryer fabric.

3. The fabric of claim 1 wherein said machine direction yarns are monofilament warp yarns having a diameter of between 0.01 and 0.03 inches.

4. The fabric of claim 3 wherein said cross-machine direction yarns are monofilament weft yarns.

5. The fabric of claim 4 wherein said base fabric is woven as one of a single layer and multi-layer fabric.

6. The fabric of claim 1 wherein said machine direction yarns are monofilament coiled yarns.

7. The fabric of claim 6 wherein said cross-machine direction yarns are monofilament pintle yarns.

8. The fabric of claim 1 wherein said machine direction yarns are rectangular in cross-section.

9. The fabric of claim 8 wherein said machine direction yarns have a height of between 0.01 inches and 0.025 inches and a width of between 0.02 inches and 0.035 inches.

10. The fabric of claim 1 wherein said fiber of said fiber batt are between 3 and 60 denier and said batt weighs between 0.25 ounces per square foot and 1.5 ounces per square foot.

11. The fabric of claim 10 wherein said base fabric has said fiber batt secured to both its outer support surface and its inner surface.

12. The fabric of claim 10 wherein said fiber batt is secured to said outer support surface.

13. The fabric of claim 12 wherein said fiber batt is multi-layered.

14. A press fabric for use in a press section of a papermaking machine consisting of a base fabric consisting of monofilament polypropylene terephthalate machine direction yarns and monofilament polypropylene terephthalate crossmachine direction yarns;

and a fiber batt consisting of polypropylene terephthalate fibers secured to at least an outer support surface of said base fabric, said fibers having a denier of between 15 and 20;

said base fabric and said fiber batt exhibiting a degree of chlorine resistance equal to that of a fabric formed of polyethylene terephthalate, an abrasion resistance equal to that of a fabric formed of nylon and an elasticity greater than that of a fabric formed of polybutylene terephthalate.

15. The press fabric of claim 14 wherein the base fabric is woven with a warp count of between 36 and 46 and a weft count of between 24 and 34.

16. The press fabric of claim 14 wherein the base fabric is coil formed.

17. The press fabric of claim 14 wherein the press fabric has an air permeability of between 60 and 160 cubic feet per minute.

* * * * *